US006566988B2

(12) United States Patent
Muzutani et al.

(10) Patent No.: US 6,566,988 B2
(45) Date of Patent: May 20, 2003

(54) STACKED TYPE DIELECTRIC RESONATOR

(75) Inventors: Yasuhiko Muzutani, Komaki (JP); Takami Hirai, Nishikamo-Gun (JP); Kazuyuki Mizuno, Kasugai (JP); Takeshi Noguchi, Saku (JP)

(73) Assignees: NGK Insulators. Ltd., Nagoya (JP); Soshin Electric Co., Ltd., Tokyo (JP)

( * ) Notice: Subject to any disclaimer, the term of this patent is extended or adjusted under 35 U.S.C. 154(b) by 0 days.

(21) Appl. No.: 09/781,692

(22) Filed: Feb. 12, 2001

(65) Prior Publication Data

US 2001/0020880 A1 Sep. 13, 2001

(30) Foreign Application Priority Data

Feb. 15, 2000 (JP) ..... 2000-036450

(51) Int. Cl.[7] ..... H01P 7/08; H01P 7/10
(52) U.S. Cl. ..... 333/219; 333/204
(58) Field of Search ..... 333/204, 219, 333/238, 202

(56) References Cited

U.S. PATENT DOCUMENTS 4,609,892 A * 9/1986 Higgins, Jr. ..... 333/204
6,060,967 A * 5/2000 Asada ..... 333/202
6,127,906 A * 10/2000 Brooks et al. ..... 333/204
6,208,226 B1 * 3/2001 Chen et al. ..... 333/202
6,222,431 B1 * 4/2001 Ishizaki et al. ..... 333/206
6,346,866 B2 * 2/2002 Nakakubo et al. ..... 333/204

FOREIGN PATENT DOCUMENTS

JP 4-043703 2/1992
JP 411266102 A * 9/1999

* cited by examiner

*Primary Examiner*—Robert Pascal
*Assistant Examiner*—Stephen E. Jones
(74) *Attorney, Agent, or Firm*—Burr & Brown

(57) ABSTRACT

A stacked type dielectric resonator includes a plurality of stripline conductors disposed in a dielectric substrate composed of a plurality of stacked dielectric layers. Ground electrode portions are continuously formed on portions of the dielectric substrate. Via holes are provided to electrically connect the respective stripline conductors to portions of the round electrode disposed on an upper or lower surface, and another portion of the ground electrode is connected to at least one side surface.

7 Claims, 3 Drawing Sheets

STACKED TYPE DIELECTRIC RESONATOR

BACKGROUND OF THE INVENTION

1. Field of the Invention

The present invention relates to a stacked type dielectric resonator which constitutes a resonance circuit in a microwave band in a range of several hundreds MHz to several GHz. In particular, the present invention relates to a stacked type dielectric resonator which has a compact size, which involves low loss, and which is usable, for example, for band-pass filters, duplexers, and oscillators.

2. Description of the Related Art

Recently, wireless communication systems such as portable telephones are diversified, it is strongly demanded for the stacked type dielectric filter to realize a compact size and low loss.

In order to realize the low loss of the stacked type dielectric filter, it is necessary to improve the no-load Q of a stacked type dielectric resonator which constitutes the stacked type dielectric filter. The no-load Q of the resonance circuit is principally determined by the loss (dielectric loss) due to the dielectric of the dielectric substrate and the loss (conductor loss) due to the stripline conductor. In general, in a low frequency band which is equivalent to or lower than the microwave band, the conductor loss is dominant for the no-load Q as compared with the dielectric loss.

Therefore, in order to realize the low loss of the stacked type dielectric filter and improve the no-load Q, the following means are conceived.

(1) The specific resistance of the conductor material for forming the stripline conductor is decreased.

(2) The width and the thickness of the stripline conductor are increased.

However, the means (1), in which the specific resistance is decreased as described above, causes such a fear that any limit may arise concerning the material and the cost. The means (2), in which the size of the stripline conductor is increased, causes such a problem that an electronic part including the stacked type dielectric resonator may become large.

In view of the above, for example, the following means has been hitherto suggested. That is, a pair of ground electrodes are formed on upper and lower surfaces of a dielectric substrate. A stripline conductor is stacked in parallel to the ground electrodes between the pair of ground electrodes with dielectric layers intervening therebetween (see Japanese Laid-Open Patent Publication No. 4-43703).

However, in this case, a concern arises such that the adjustment for the resonance frequency may involve a number of difficulties, because the short-circuited end of the stripline conductor is exposed to only the upper and lower surfaces of the dielectric substrate.

SUMMARY OF THE INVENTION

The present invention has been made taking the foregoing problems into consideration, an object of which is to provide a stacked type dielectric resonator which has a simple structure, which makes it possible to effectively reduce the conductor loss which would be otherwise caused by a stripline conductor, and which makes it possible to improve the no-load Q of the resonator.

Another object of the present invention is to provide a stacked type dielectric resonator which makes it possible to adjust the resonance frequency with ease, in addition to the requirement described above.

According to the present invention, there is provided a stacked type dielectric resonator comprising a dielectric substrate including a plurality of dielectric layers stacked and integrated into one unit; and a ground electrode and a stripline conductor stacked with each other with the dielectric layer interposed therebetween; wherein a first end of the stripline conductor is electrically connected to the ground electrode; and the stripline conductor is provided with an additional member for increasing a portion through which a high frequency current in a microwave band flows.

Accordingly, in the present invention, the portion, through which the high frequency current in the microwave band flows, is successfully increased by the aid of the additional member. Therefore, it is possible to effectively reduce, with the simple structure, the conductor loss which would be otherwise caused by the stripline conductor. Further, it is possible to improve the no-load Q of the resonator.

It is preferable that the additional member is composed of a via hole for electrically connecting the stripline conductor and the ground electrode. In this arrangement, it is preferable that the ground electrode is stacked with the dielectric layers intervening therebetween so that the stripline conductor is interposed therebetween; and the additional member is composed of via holes extending in both directions from the stripline conductor to portions of the ground electrode respectively. By doing so, the portion, through which the high frequency current in the microwave band flows, is further increased, and thus it is possible to further improve the no-load Q of the resonator.

Especially, when the via hole is formed at a position deviated toward the first end of the stripline conductor, the conductor loss, which may be caused by the stripline conductor, can be effectively reduced, while ensuring the electrical length of the stripline conductor.

When the first end of the stripline conductor is electrically connected to the ground electrode at the surface of the dielectric substrate, the first end of the stripline conductor is exposed from the dielectric substrate during the production process for the stacked type dielectric resonator. Therefore, it is easy to change the length of the stripline conductor, and thus it is easy to adjust the resonance frequency.

The above and other objects, features, and advantages of the present invention will become more apparent from the following description when taken in conjunction with the accompanying drawings in which a preferred embodiment of the present invention is shown by way of illustrative example.

DETAILED DESCRIPTION OF THE INVENTION

Illustrative embodiments of the stacked type dielectric resonator according to the present invention will be explained below with reference to FIGS. 1 to 3.

Figure 1:
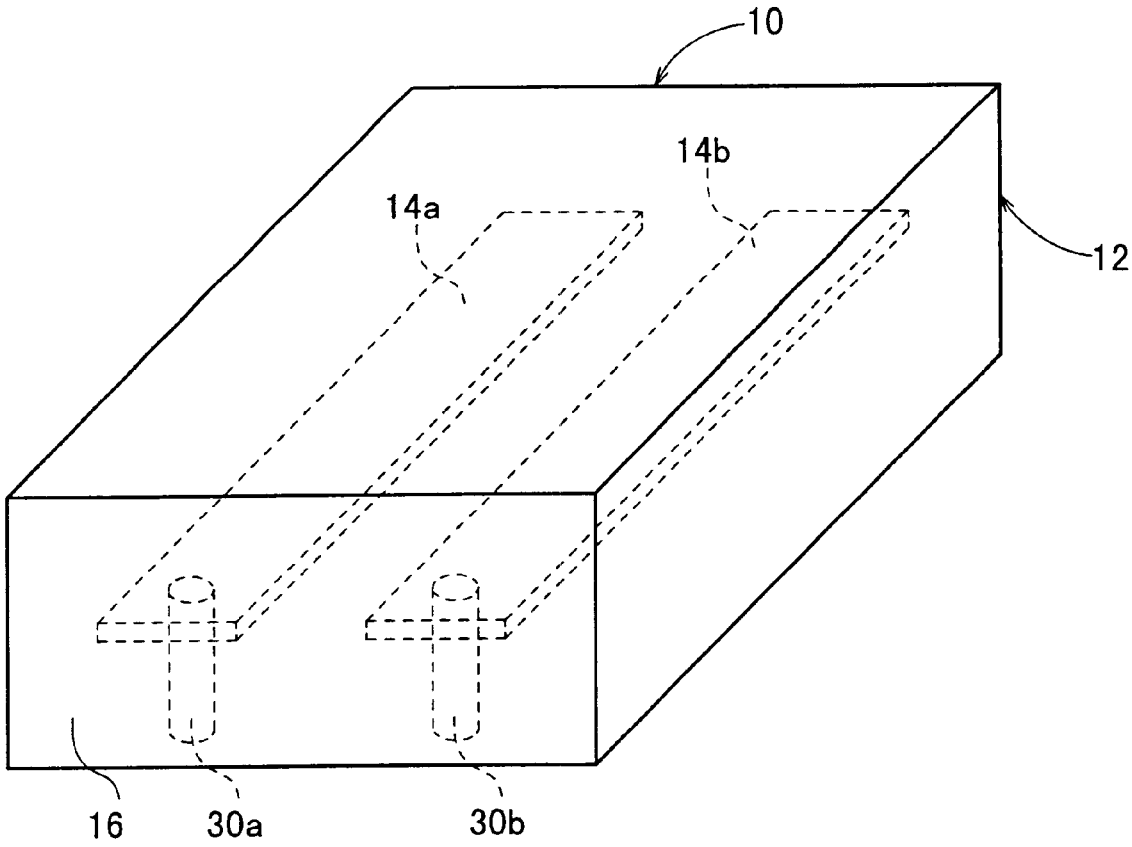
FIG. 1 shows a perspective view illustrating an arrangement of a stacked type dielectric resonator according to an embodiment of the present invention.

As shown in FIG. 1, a stacked type dielectric resonator according to an embodiment of the present invention comprises a plurality of (for example, two of) stripline conductors (¼ wavelength) 14*a*, 14*b* disposed in a dielectric substrate 12 constructed by stacking a plurality of dielectric layers.

A ground electrode 16 is formed on the surface of the dielectric substrate 12. Specifically, for example, as shown in FIG. 2, the ground electrode 16 is continuously formed over a range including a part or all of the upper surface, a part or all of the lower surface, and a part or all of at least one side surface.

Accordingly, the following structure is obtained. That is, the upper surface ground electrode 16*a* is stacked over the stripline conductors 14*a*, 14*b* with a dielectric layer 18 interposed therebetween. The lower surface ground electrode 16*b* is stacked under the stripline conductors 14*a*, 14*b* with a dielectric layer 20 interposed therebetween.

Figure 2:
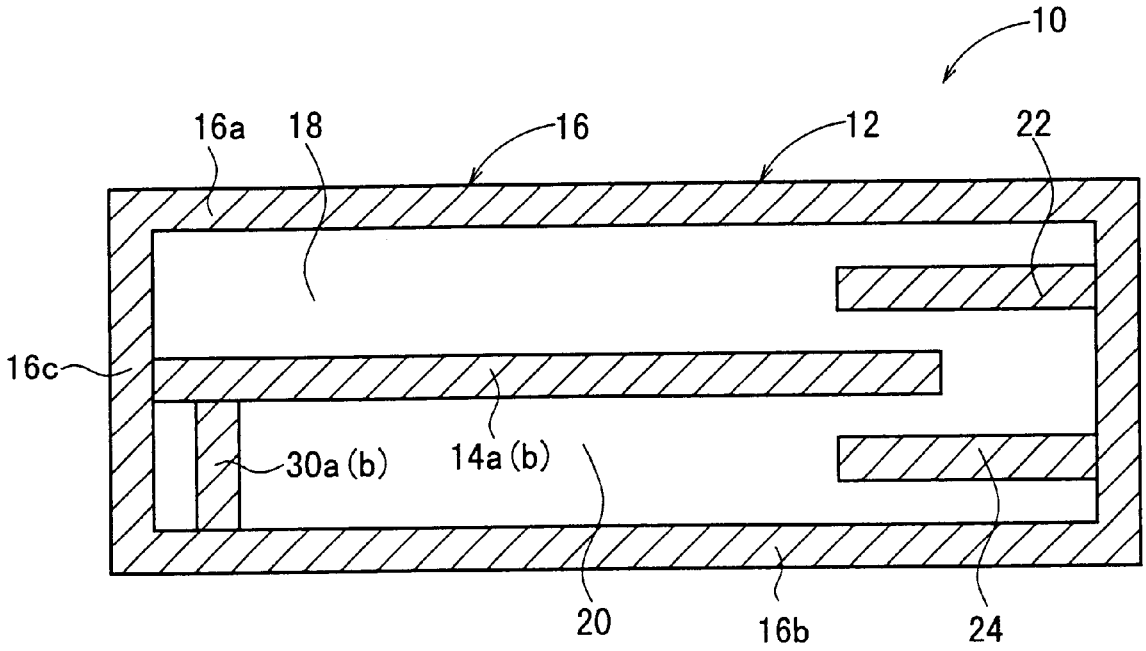
FIG. 2 shows a longitudinal sectional view illustrating the arrangement of the stacked type dielectric resonator according to the embodiment of the present invention.

In the embodiment of the present invention, as shown in FIG. 2, the arrangement is constructed such that respective first ends of the stripline conductors 14*a*, 14*b* are electrically connected and short-circuited with respect to the ground electrode 16*c* formed on the side surface of the dielectric substrate 12.

In this arrangement, for example, respective open ends of the stripline conductors 14*a*, 14*b* are capacitively coupled to the ground electrode 16 by the aid of inner layer ground electrodes 22, 24. Accordingly, it is possible to shorten the electrical length of each of the stripline conductors 14*a*, 14*b*.

That is, when a desired resonance frequency is obtained, the electrical length of the stripline conductor 14*a*, 14*b* can be shortened as compared with a structure in which the inner layer ground electrodes 22, 24 are not provided. Therefore, it is possible to miniaturize the stacked type dielectric resonator 10.

As shown in FIGS. 1 and 2, the stacked type dielectric resonator 10 according to the embodiment of the present invention is provided with via holes 30*a*, 30*b* which electrically connect the respective stripline conductors 14*a*, 14*b*, for example, to the lower surface ground electrode 16*b* respectively.

Accordingly, in the embodiment of the present invention, it is possible to increase the portion through which the high frequency current in the microwave band flows, owing to the formation of the via holes 30*a*, 30*b*. As a result, it is possible to effectively reduce, with the simple structure, the conductor loss which would be otherwise caused by the stripline conductors 14*a*, 14*b*. Further, it is possible to improve the no-load Q of the stacked type dielectric resonator 10.

Especially, when the via holes 30*a*, 30*b* are formed at positions deviated toward the first ends (short-circuited ends) of the stripline conductors 14*a*, 14*b*, then the conductor loss, which may be caused by the stripline conductors 14*a*, 14*b*, can be effectively reduced, while ensuring the electrical length of the stripline conductors 14*a*, 14*b*. Accordingly, this arrangement is preferably adopted.

Figure 3:
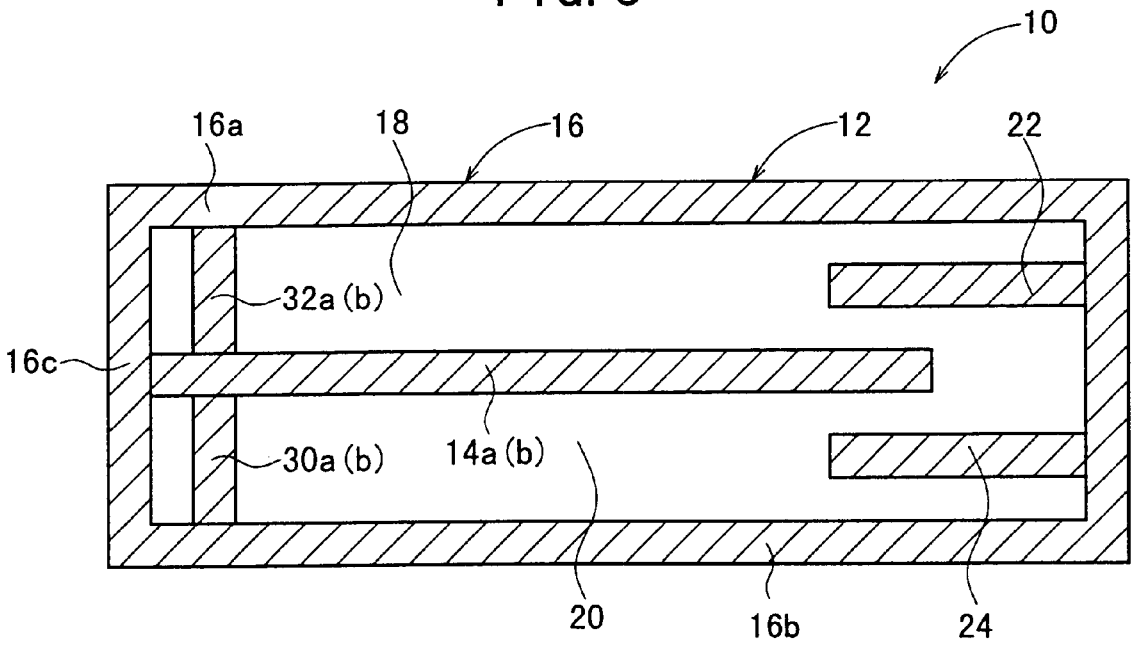
FIG. 3 shows a longitudinal sectional view illustrating an arrangement of a stacked type dielectric resonator according to another embodiment.

Alternatively, as shown in FIG. 3, it is also preferable to provide first via holes 30*a*, 30*b* which electrically connect the respective stripline conductors 14*a*, 14*b* and the lower surface ground electrode 16*b*, and second via holes 32*a*, 32*b* which electrically connect the respective stripline conductors 14*a*, 14*b* and the upper surface ground electrode 16*a*. In this arrangement, the portion, through which the high frequency current in the microwave band flows, is further increased. Thus, it is possible to further improve the no-load Q of the stacked type dielectric resonator 10.

Further, in the embodiment of the present invention, the first ends of the stripline conductors 14*a*, 14*b* are electrically connected to the ground electrode 16*c* at the side surface of the dielectric substrate 12. Therefore, the first ends of the stripline conductors 14*a*, 14*b* are exposed from the dielectric substrate 12, in the production process for the stacked type dielectric resonator 10 according to the embodiment of the present invention. In this case, it is easy to change the length of the stripline conductor 14*a*, 14*b*. Thus, it is easy to adjust the resonance frequency.

It is a matter of course that the stacked type dielectric resonator according to the present invention is not limited to the embodiments described above, which may be embodied in other various forms without deviating from the gist or essential characteristics of the present invention.

What is claimed is:

1. A stacked type dielectric resonator comprising:

a dielectric substrate including a plurality of dielectric layers stacked and integrated into one unit;

ground electrode portions provided continuously on at least a portion of an upper surface, a lower surface, and at least one side surface of the dielectric substrate; and a stripline conductor being stacked such that one of said dielectric layers is interposed between at least one of said ground electrode portions and said stripline conductor, wherein a first end of said stripline conductor is electrically connected to a ground electrode portion extending over said at least one side surface, and another portion of said strip line conductor is electrically connected to at least one of said ground electrode portions extending over said upper and lower surfaces of said dielectric substrate through a via hole for increasing a portion through which a high frequency current in a microwave band flows, said via hole extending generally perpendicular to a width plane of said stripline conductor.

2. The stacked type dielectric resonator according to claim 1, wherein said via hole is formed at a position deviated toward said first end of said stripline conductor.

3. The stacked type dielectric resonator according to claim 1, wherein:

at least two of said ground electrode portions are stacked with said dielectric layers intervening therebetween such that said stripline conductor is interposed between said ground electrode portions and said dielectric layers; and a plurality of via holes, at least one of said via holes extending in each direction from said stripline conductor to said at least two portions of said ground electrode portions respectively.

4. The stacked type dielectric resonator according to claim 3, wherein each of said via holes is formed at a position deviated toward said first end of said stripline conductor.

5. A stacked type dielectric resonator comprising:

a dielectric substrate including a plurality of dielectric layers stacked and integrated into one unit;

ground electrode portions provided continuously on at least a portion of an upper surface, a lower surface, and at least one side surface of the dielectric substrate; and a stripline conductor being stacked such that one of said dielectric layers is interposed between at least one of said ground electrode portions and said stripline conductor, wherein a first end of said stripline conductor is electrically connected to a ground electrode portion extending over said at least one side surface, and another portion of said strip line conductor, spaced a predetermined distance from said first end, is electrically connected to at least one of said ground electrode portions extending over said upper and lower surfaces of said dielectric substrate through a via hole for increasing a portion through which a high frequency current in a microwave band flows.

6. The stacked type dielectric resonator according to claim 5, wherein:

at least two of said ground electrode portions are stacked with said dielectric layers intervening therebetween such that said stripline conductor is interposed between said ground electrode portions and said dielectric layers; and a plurality of via holes, at least one of said via holes extending in each direction from said stripline conductor to said at least two portions of said ground electrode portions respectively.

7. The stacked type dielectric resonator according to claim 6, wherein each of said via holes extends from said another portion of said stripline conductor.

* * * * *

UNITED STATES PATENT AND TRADEMARK OFFICE

CERTIFICATE OF CORRECTION

PATENT NO. : 6,566,988 B2 
DATED : May 20, 2003
INVENTOR(S) : Yasuhiko Mizutani et al.

It is certified that error appears in the above-identified patent and that said Letters Patent is hereby corrected as shown below:

Title page,
Item [75], Inventors, please change "Yasuhiko Muzutani" to -- Yasuhiko Mizutani --.

Signed and Sealed this

Twenty-sixth Day of August, 2003

JAMES E. ROGAN
*Director of the United States Patent and Trademark Office*